US006277197B1

(12) United States Patent
Gottwald

(10) Patent No.: US 6,277,197 B1
(45) **Date of Patent: *Aug. 21, 2001**

(54) APPARATUS FOR DIRECT OR INDIRECT APPLICATION OF A LIQUID OR PASTY COATING MEDIUM ONTO A TRAVELING MATERIAL WEB, NOTABLY OF PAPER OR CARDBOARD

(75) Inventor: Ingo Gottwald, Steinheim (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/466,952

(22) Filed: Dec. 20, 1999

Related U.S. Application Data

(63) Continuation of application No. 08/988,937, filed on Dec. 11, 1997, now Pat. No. 6,004,394.

(30) Foreign Application Priority Data

Dec. 16, 1996 (DE) ..... 196 52 289

(51) Int. Cl.[7] ..... B05C 3/02
(52) U.S. Cl. ..... 118/414; 118/262
(58) Field of Search ..... 118/414, 419, 118/117, 262, 261

(56) References Cited

U.S. PATENT DOCUMENTS

| | | | |
|---|---|---|---|
| 3,273,535 | 9/1966 | Krikorian | 118/413 |
| 4,245,582 | 1/1981 | Alheid et al. | 118/119 |
| 4,250,211 | 2/1981 | Damrau et al. | 118/411 |
| 4,839,201 | 6/1989 | Rantanen et al. | 118/410 |
| 5,103,732 | 4/1992 | Wells et al. | 118/410 |
| 5,433,781 | 7/1995 | Bernert | 118/118 |
| 5,647,907 | 7/1997 | Van der Meulen | 118/413 |

FOREIGN PATENT DOCUMENTS

| | | | |
|---|---|---|---|
| 40 01 734 A1 | 1/1990 | (DE) | B05C/11/04 |
| 42 41 792 A1 | 12/1992 | (DE) | B05C/5/02 |
| 195 16 223 | 5/1995 | (DE) | B05C/5/02 |

*Primary Examiner*—Brenda Adele Lamb
(74) *Attorney, Agent, or Firm*—Taylor & Aust, P.C.

(57) ABSTRACT

An apparatus for direct or indirect application of at least one liquid or pasty medium onto a traveling material web, notably of paper or cardboard, includes at least one applicator for the medium. Coordinated with the applicator is a backing roll for receiving the medium in the indirect application or for carrying the material web in the direct application. The applicator includes a coating doctor and, arranged a distance from the coating doctor in a direction opposite to the direction of rotation of the backing roll, a second doctor element. The second doctor element bounds, with the coating doctor, a coating chamber for the medium. The coating doctor and the second doctor element are retained on a common, substantially rigid doctor bed and bound together with the backing roll surface and the doctor bed surface the coating chamber. At least one feed line for feeding the medium to the coating chamber is provided in the common doctor bed.

7 Claims, 1 Drawing Sheet

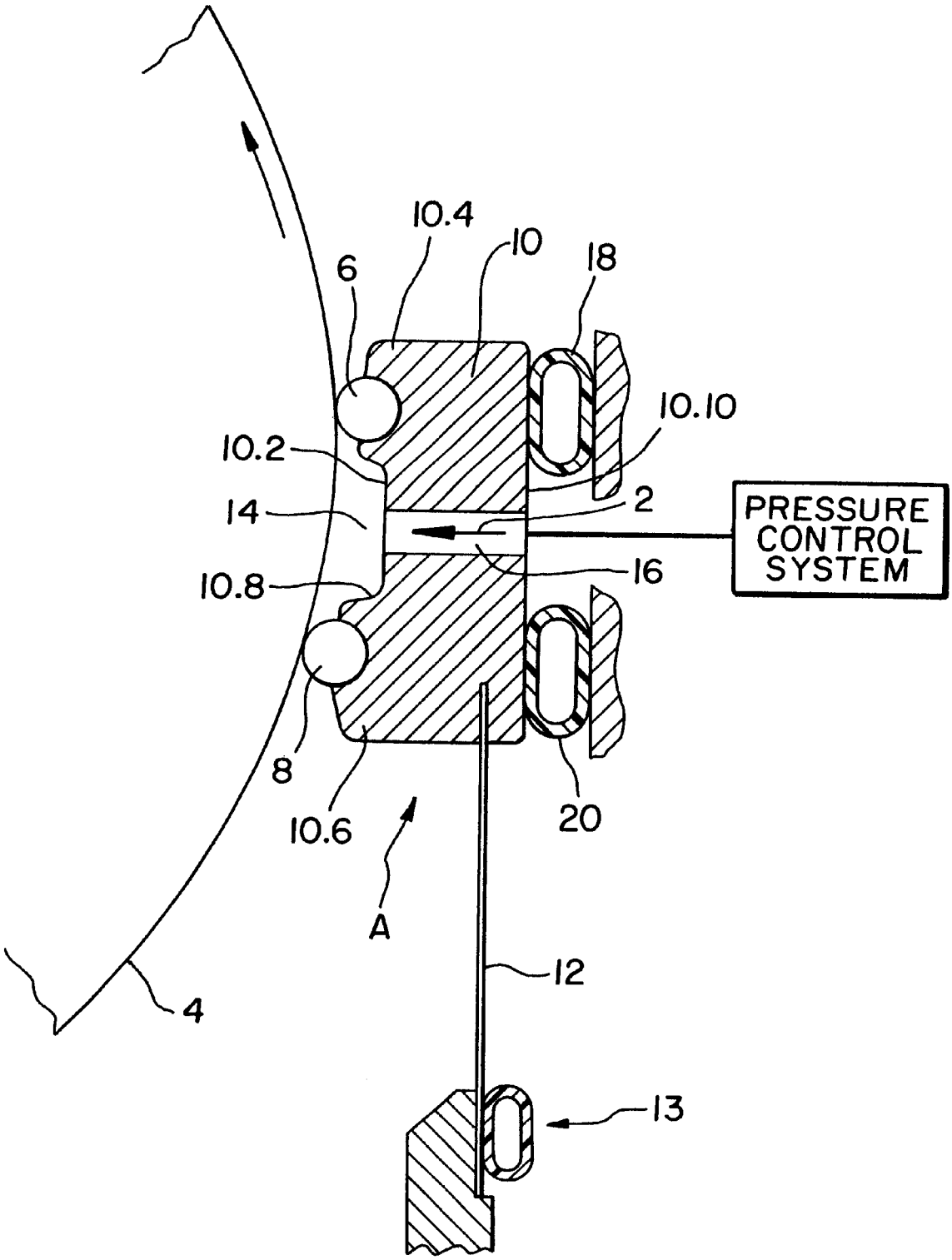
10.4
10
18
6
10.10
10.2
2
14
PRESSURE CONTROL SYSTEM
16
10.8
8
10.6
20
A
12
4
13

APPARATUS FOR DIRECT OR INDIRECT APPLICATION OF A LIQUID OR PASTY COATING MEDIUM ONTO A TRAVELING MATERIAL WEB, NOTABLY OF PAPER OR CARDBOARD

This is a continuation of application Ser. No. 08/988,937 filed Dec. 11, 1997 now U.S. Pat. No. 6,004,394.

BACKGROUND OF THE INVENTION

1. Field of the Invention

The present invention relates to an apparatus for direct or indirect application of a liquid or pasty coating medium onto a traveling material web, notably of paper or cardboard.

2. Description of the Related Art

Apparatuses for direct or indirect application of a liquid or pasty coating medium onto a traveling fiber material web are used in so-called coating systems for providing a traveling material web, formed for example of paper, cardboard or a textile material, on one or both sides with one or several layers of the liquid or pasty coating medium, for example color, starch, impregnating fluid or the like.

In the so-called direct application, the liquid or pasty coating medium is applied by an applicator system directly onto the surface of the traveling fiber material web, the latter being carried during application on a rotating countersurface, for example an endless belt or a backing roll. In the indirect application of the medium, the liquid or pasty coating medium is first applied onto a substrate, for example the surface of a backing roll configured as an applicator roll. The coating medium is then transferred from the applicator roll to the fiber material web in a nip through which the fiber material web passes.

Employed for the above applicational purpose, e.g., are applicators whose metering system is equipped with an open-jet nozzle. As generally known, these applicators allow easy and relatively uncomplicated operation and the parts are not subject to a high level of wear. Therefore, the applicators are relatively maintenance-friendly and are normally used for web travel speeds up to 1500 meters/min. They are especially suited for papers sensitive to traction, for example, thin papers, where the risk of web break is relatively high.

On the other hand, when a coating system is to be operated at a still higher speed (e.g., above 1500 m/min), when a special depth of penetration is desired or an especially light coating weight is to be applied onto the fiber material web, applicators can be used which apply the liquid or pasty medium by way of a coating chamber formed between a doctor element (blade, bar or roll doctor) and a back-up strip. The liquid or pasty medium is usually kept at a certain pressure in this coating chamber.

Known from the German utility model DE-GM 84 14 904.3 is an applicator as described above for direct application of a liquid or pasty medium onto a traveling material web, notably of paper or cardboard, including a metering system and, coordinated with it, a rotating backing roll which supports the traveling fiber material web during application. The metering system includes a metering doctor mounted in a doctor bed and a back-up strip arranged a distance from the metering doctor in a direction opposite to the direction of rotation of the backing roll. The back-up strip bounds together with the metering doctor and the backing roll surface a chamber which is supplied with the medium by way of a feed slot. Usually provided on the metering system is a run-off surface across which the medium applied at surplus and issuing out of the coating chamber over the back-up strip drains under the effect of gravity. The medium is collected in a collection system and subsequently recycled to a medium circulation.

Equipped with coating chambers, these conventional applicators, however, have considerable disadvantages. For example, the ratio of applied to surplus, i.e., overflow medium quantity, is approximately 1:10. Consequently, a considerable medium quantity needs to be circulated in the operation of the applicator, requiring large and efficient pumps, filters, pipelines, control organs and, thus, a high overall energy demand of the applicator resulting in high operating costs. Therefore, such applicators are no longer competitive from an economic view. Furthermore, it has also been found that the coating quality achieved with these applicators is poor.

Known from German Patent Application No. P 44 44 779.5, assigned to the assignee of the present invention, is an apparatus for direct or indirect application of at least one liquid or pasty medium onto a traveling material web, notably of paper or cardboard, including at least one applicator for the medium. Coordinated with the applicator is a backing roll for receiving the liquid medium in the indirect application or for carrying the fiber material web in the direct application. The applicator includes a coating doctor as well as a cleaning doctor arranged a distance from the coating doctor in a direction opposite to the direction of rotation of the backing roll. The cleaning doctor bounds with the coating doctor a coating chamber for the medium. The applicator is equipped with openings or conduits through which the liquid or pasty medium issues out of the coating chamber in a direction substantially opposite to the direction of rotation of the roll. The medium impinges at least partly outside the coating chamber on the surface area of the backing roll, or the fiber material web, bordering on the cleaning doctor. The cleaning doctor features a doctor bar supported by a blade-like holder equipped with openings or conduits serving to enable rinsing or prewetting with the medium for cleaning purposes.

The aforementioned prior art's very unfavorable ratio between applied and surplus or overflow medium quantity has already been improved considerably with this type of applicator. The quality of the coating produced has also been boosted due to the self-cleaning effect of the cleaning doctor bar. Realizing these positive coating results, however, involves considerable equipment and engineering expense. In view of the manufacturing costs of the entire apparatus, therefore, it would be desirable to further simplify the applicator design while maintaining, or even improving, the coating results.

SUMMARY OF THE INVENTION

The present invention provides a simple and effective apparatus which extensively avoids the disadvantages associated with the prior art and which allows the production of a high quality coating.

This apparatus for direct or indirect application of a liquid or pasty medium onto a traveling material web, notably of paper or cardboard, includes at least one applicator for the medium. Associated with the applicator is a backing roll receiving the liquid medium in the indirect application or carrying the fiber material web in the direct application. The applicator includes a coating doctor and, arranged a distance from the coating doctor in a direction opposite to the direction of rotation of the backing roll, a second doctor element. The second doctor element bounds with the coating doctor a coating chamber for the medium. The coating doctor and the second doctor element are mounted on a common, substantially rigid doctor bed and bound together with the backing roll surface and the doctor bed surface the coating chamber. Provided in the common doctor bed is at least one feed line for feeding the medium into the coating chamber.

Employed as a coating doctor and second doctor element are doctor bars or roll doctor elements. Also possible are other suitable doctor elements, and the coating doctor and the second doctor element may be either identical or different types of doctor elements. Employment of a doctor blade, which may be operated in the so-called stiff-blade or bent-blade mode, for example, has also led to positive results with the coating doctor. The coating doctor can have a smooth doctor surface. Alternatively, the coating doctor can have a profiled, rough-milled or coated doctor surface. Moreover, the coating doctor may be perforated or slotted so as to allow, when needed, an overflow of surplus medium. The second doctor element can be configured as a back-up, sealing or bounding element for the coating chamber and/or as a cleaning doctor element, or cleaning doctor. In using the second doctor element as a cleaning doctor, a profiled or rough-milled doctor surface has primarily proved itself. As needed, the second doctor also may be powered, requiring a drive in such case. With the coating doctor also being powered, a common drive is suitably provided for the second doctor element and the coating doctor. The diameter of a coating doctor bar or cleaning doctor bar (second doctor element) ranges approximately between 10 and 40 millimeters. Generally, the coating doctor and the second doctor element may be of same or different size. Provided in the common doctor bed, the feed line for feeding the coating medium into the coating chamber, e.g., may be realized by a plurality of holes or other openings juxtaposed in the direction of longitudinal expanse of the doctor bed, for example slots, slits, nozzles and the like. The feed line connects suitably via a suitable adapter to a feed system for the medium. Moreover, the inventional apparatus may be equipped with collection systems, known as such, for collecting the surplus medium issuing out of the coating chamber, so that the surplus medium can be recycled to a medium circulation.

Owing to the particular arrangement of the coating doctor, of the second doctor element, and of the doctor bed as well as their specific combination to an applicator, the apparatus according to the invention has a structure which is greatly simplified as compared to conventional apparatuses and includes a considerably reduced number of components. Therefore, the manufacturing expense of the inventional applicator can be much lower, both from manufacturing-related and economic aspects. Furthermore, the applicator of the inventional apparatus has a very compact and space-saving design and thus can be used under congested conditions of space. Moreover, it has surprisingly been demonstrated that the ratio between applied and surplus or overflow medium amounts can be drastically reduced to a value of about 1:2. As a result, the amount of medium to be circulated in the operation of the applicator is also minimized. This, in turn, allows the use of smaller and more cost-effective pumps, filters and the like, thereby considerably reducing the overall energy demand as well as the manufacturing and operating costs of the apparatus. The coaction of the coating doctor and the second doctor element, as well as their inherent self-cleaning properties, allows the realization of a very uniform and high value coating quality. As compared to conventional apparatuses, whose applicators are configured merely for operation with a single, preset direction of rotation of the backing roll, the inventional applicator is usable with different or changing directions of rotation of the backing roll, without requiring engineering or design modifications on the apparatus itself. Thus, the application spectrum of the inventional apparatus expands further as compared to the prior art. Suitable selection and configuration of the two doctor elements makes it possible for the coating doctor to assume, upon reversal of the backing roll direction of rotation, the function of the second doctor element, and vice versa.

According to one configuration feature of the inventional apparatus, the doctor bed is of a single-part design. This allows an especially simple design and also facilitates the fabrication of the feed line provided in the doctor bed, which, e.g., may be configured as a plain through bore. However, the invention is not limited to a single-part doctor bed. As needed, the doctor bed may also be composed of several parts.

Another configuration variant of the inventional apparatus provides for mounting the doctor bed movably on a doctor bed holder. This installation can be releasable again, allowing separation of the doctor bed from the doctor bed holder, if needed. The movable mounting of the doctor bed on the doctor bed holder guarantees that the coating doctor and the cleaning doctor can be set at exact fit on the opposite backing roll surface, or on the fiber material web, and—as will be illustrated in detail yet—pressed onto it, thus largely sealing the coating chamber formed.

It is also possible for the doctor bed holder to include at least one movable and/or elastically deformable doctor bed holder element on which the doctor bed is mounted. Notably a thin, elastically bending blade or holder blade extending substantially across the entire machine width has proved itself as such a doctor bed holder element. The doctor bed is secured one-sidedly on the free end of such a blade or holder blade, for example, by clamping, screwing or the like. Of course, other suitable doctor bed holder elements are also usable, including such wherein the doctor bed is joined to the doctor bed holder element by way of several mounting points or mounting sections, which in case of need may be jointed. The type of doctor bed fastening to the doctor bed holder element as well as its configuration are very important, especially when the applicator is also meant to be operated with the direction of backing roll rotation reversed.

According to a further configuration feature, the inventional apparatus includes at least one pressure system acting directly or indirectly on the doctor bed. The pressure system forces the coating doctor and/or second doctor element mounted on the common doctor bed toward the backing roll at a preset pressure, and thus onto the backing roll surface or the surface of the material web. Possible, hence, is not only an effective sealing of the coating chamber bounded by the coating doctor, the second doctor element, the backing roll surface and the doctor bed surface, but also the generation of a desired length and/or cross profile by a defined adjustment of the contact pressure, as well as a manipulation of the doctor effect and/or cleaning effect of the second doctor element. The pressure system may act on a single region or on several regions of the doctor bed that differ from one another. The regions may differ from one another evenly across substantially the entire machine width and/or zonewise. Common or separate pressure elements may be provided for the coating doctor and the second doctor element, the two doctor elements being acted upon by the pressure elements in mutual dependence or independently.

Suitable pressure elements, e.g., are pressure hoses or other suitable actuators, such as mechanical, pneumatic, hydraulic, electric, electromagnetic actuators etc. The pressure system is suitably incorporated in a control loop of a feedback control system controlling the contact pressure of the coating doctor and of the second doctor element in contingence on preset set values. These preset set values can be, for example, for the length and cross profile as well as a specific degree of cleanliness of the surface being coated.

Lastly, the inventional apparatus includes in the framework of a further embodiment at least one pressure control system for controlling the pressure of the liquid or pasty medium fed via the feed line in the common doctor bed to the coating chamber. Also achievable by use of the pressure control is an appropriate control of the medium quantity channeled to the coating chamber. Depending on the configuration of the feed line and of the pressure control system, a pressure change effected for pressure control may be uniform substantially across the entire machine width and/or locally different. Thus the properties of the obtained coating can be influenced by use of the pressure control. The pressure control system is also suitably incorporated in a control loop of a feedback control system, which may be the same feedback control system that has already been illustrated in conjunction with the pressure system.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic cross-sectional illustration of one embodiment an inventional apparatus in the area of an applicator.

The exemplification set out herein illustrates one preferred embodiment of the invention, in one form, and such exemplification is not to be construed as limiting the scope of the invention in any manner.

DETAILED DESCRIPTION OF THE INVENTION

The variant of the inventional apparatus illustrated in the figure, for direct or indirect application of a liquid or pasty medium 2 onto a traveling fiber material web, notably of paper or cardboard, includes an applicator A for the medium 2 and, associated with applicator A, a backing roll 4. In the indirect application, backing roll 4 serves to accept medium 2. In the direct application, backing roll 4 serves to carry or support the material web. The direction of rotation of backing roll 4 is indicated in the drawing by an arrow.

Applicator A includes a coating doctor 6 and a second doctor element 8, hereinafter called cleaning doctor 8, which are retained in a common, substantially rigid and single-part or unitary doctor bed 10. The cleaning doctor 8 is arranged a distance from the coating doctor 6 in a direction opposite to the direction of rotation of backing roll 4. The doctor bed 10 has a substantially rectangular, somewhat elongated cross-sectional shape with two end sections 10.4, 10.6 protruding from the same side face 10.2. Coating doctor 6 and cleaning doctor 8 are mounted in end sections 10.4 and 10.6. Both coating doctor 6 and cleaning doctor 8 are configured as round doctor bars and have identical diameters, measuring approximately between 10 and 40 mm. The coating doctor 6 has a smooth doctor surface, whereas cleaning doctor 8 has a textured doctor surface. The doctor bed 10 is retained movably on a doctor bed holder 13. More exactly, the bottom section of doctor bed 10 is detachably attached to the top, free end of a doctor bed holder element 12 configured as a thin, elastic blade or holder blade. Doctor bed holder element 12 is mounted, in turn, on the structure of the apparatus.

Coating doctor 6 and cleaning doctor 8, in one operating position of the applicator A, contact flush backing roll 4 or the material web carried by backing roll 4. Coating doctor 6 and cleaning doctor 8 bound together with the backing roll surface and the doctor bed surface facing backing roll 4 (that is, more exactly, with the recess 10.8 formed by the protruding end sections 10.4, 10.6) a coating chamber 14 which extends substantially across the entire machine width and is suitably sealed on its lateral ends. Provided in doctor bed 10 is a feed line 16 for feeding medium 2 into coating chamber 14. In the case of the illustrated variant, feed line 16 includes a plurality of central through holes 16 juxtaposed in the direction of longitudinal expanse of doctor bed 10 and emptying in the area of recess 10.8 in coating chamber 14. On the side of doctor bed 10 away from backing roll 4, conduits 16 connect via a suitable adapter to a feed system for medium 2. The adapter as well as the feed system, including pumps, pipe or hose lines, filters, etc., have been omitted from the drawing for the sake of clarity. The feed direction of the liquid or pasty medium 2 to doctor bed 10 and coating chamber 14 is indicated by an arrow.

Moreover, the apparatus includes two parallel pressure hoses 18, 20 that are arranged in the area of a side face 10.10 of doctor bed 10 away from backing roll 4. Hoses 18 and 20 act on a top and a bottom section of side face 10.10 and force doctor bed 10 on the backing roll surface, or on the surface of the material web, against the elastic spring effect of doctor bed holder element 12. The top pressure hose 18 is associated with coating doctor 6, and the bottom pressure hose 20 is associated with cleaning doctor 8. As needed, coating doctor 6 and cleaning doctor 8 may be acted upon separately or jointly with the same or different pressures, obtaining a desired length and/or cross profile as well as a specific cleaning effect.

Both the pressure system 18, 20 and the previously described feed system for medium 2 are included in a control loop of a common feedback control that controls the contact pressure of coating doctor 6 and cleaning doctor 8 as well as the pressure acting on medium 2. The control is performed in contingence on preset set values for the length and cross profile, the medium pressure, medium quantity, and the desired degree of cleanliness of the surface to be coated.

The inventional apparatus is also equipped with collection systems for collecting the surplus medium 2 issuing out of coating chamber 14 so that the surplus medium 2 is recycled to a medium circulation. These collection systems are not shown in the figure.

The illustrated configuration of applicator A of the inventional apparatus, due to the one-sided fastening on the top, free end of doctor bed holder element 12, is intended only for operation with the direction of rotation of backing roll 4 as shown in the figure.

The invention is not limited to the above exemplary embodiment, which merely serves the general explanation of the core idea of the invention. Rather, the apparatus according to the invention may within the scope of protection assume also embodiments other than those described above. Notably, the apparatus may include features which represent a combination of the relevant individual features. When using a doctor bar for the coating doctor and/or the second doctor element, the apparatus may also be equipped with a doctor bar rinsing system.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for one of direct and indirect application of at least one coating medium onto a traveling fiber material web, said apparatus comprising:

a rotating backing roll having a backing roll surface and a direction of rotation, said backing roll being configured for one of receiving the medium in the indirect application and carrying the fiber material web in the direct application; and an applicator associated with said backing roll surface, said applicator including:

a substantially cylindrical coating doctor bar;

a second substantially cylindrical doctor bar disposed before said coating doctor bar relative to said direction of rotation; and a single rigid doctor bed having first and second protruding end sections and a recessed portion therebetween, said first protruding end section and said second protruding end section directly and rotatably carrying said coating doctor bar and said second doctor bar, respectively, said doctor bed retaining each of said coating doctor bar and said second doctor bar against said backing roll surface, said coating doctor bar, said second doctor bar, said backing roll surface, said protruding end sections and said recessed portion defining a coating chamber for the medium therebetween, said recessed portion having therein at least one feed line configured for feeding the medium to said coating chamber.

2. The apparatus of claim 1, wherein said doctor bed is of unitary construction.

3. The apparatus of claim 1, further comprising a doctor bed holder, said doctor bed being mounted movably on said doctor bed holder.

4. The apparatus of claim 1, further comprising at least one pressure system configured for acting on said doctor bed and thereby pressing at least one of said coating doctor bar and said second doctor bar at a preset pressure against said backing roll.

5. The apparatus of claim 1, further comprising at least one pressure control system configured for controlling a pressure of the medium fed via said at least one feed line in said doctor bed to said coating chamber.

6. The apparatus of claim 1, wherein said coating doctor bar has a smooth surface and said second doctor bar has a textured surface.

7. An apparatus for one of direct and indirect application of at least one coating medium onto a traveling fiber material web, said apparatus comprising:

a rotating backing roll having a backing roll surface and a direction of rotation, said backing roll being configured for one of receiving the medium in the indirect application and carrying the fiber material web in the direct application;

an applicator associated with said backing roll surface, said applicator including:

a substantially cylindrical coating doctor bar;

a second substantially cylindrical doctor bar disposed before said coating doctor bar relative to said direction of rotation; and a substantially rigid doctor bed having a doctor bed surface directly and rotatably carrying each of said coating doctor bar and said second doctor bar, said doctor bed retaining each of said coating doctor bar and said second doctor bar against said backing roll surface, said coating doctor bar, said second doctor bar, said backing roll surface and said doctor bed surface defining a coating chamber for the medium therebetween, said doctor bed having at least one feed line configured for feeding the medium to said coating chamber; and a doctor bed holder including at least one elastically deformable doctor bed holder element, said at least one doctor bed holder element comprising a holder blade further carrying said doctor bed with said coating doctor bar and said second doctor bar mounted therein, said doctor bed being fixed upon and carried by said at least one doctor bed holder element.

* * * * *